US010179340B2

(12) United States Patent
Ikeda et al.

(10) Patent No.: US 10,179,340 B2
(45) Date of Patent: Jan. 15, 2019

(54) ACTIVATOR APPLYING DEVICE, HYDRAULIC TRANSFER APPARATUS INCORPORATING THE SAME ACTIVATOR APPLYING DEVICE, AND ARTICLE WITH HYDRAULICALLY TRANSFERRED PATTERN MANUFACTURED WITH THE SAME HYDRAULIC TRANSFER APPARATUS

(71) Applicant: TAICA CORPORATION, Tokyo (JP)

(72) Inventors: Wataru Ikeda, Tokyo (JP); Akiko Tomiki, Tokyo (JP)

(73) Assignee: TAICA CORPORATION, Tokyo (JP)

( * ) Notice: Subject to any disclaimer, the term of this patent is extended or adjusted under 35 U.S.C. 154(b) by 460 days.

(21) Appl. No.: 14/773,561

(22) PCT Filed: Mar. 6, 2014

(86) PCT No.: PCT/JP2014/055799
§ 371 (c)(1),
(2) Date: Sep. 8, 2015

(87) PCT Pub. No.: WO2014/142000
PCT Pub. Date: Sep. 18, 2014

(65) Prior Publication Data

US 2016/0016191 A1 Jan. 21, 2016

(30) Foreign Application Priority Data

Mar. 15, 2013 (JP) ..... 2013-053000

(51) Int. Cl.
*B05C 1/08* (2006.01)
*B05C 11/11* (2006.01)
(Continued)

(52) U.S. Cl.
CPC ..... *B05C 1/0817* (2013.01); *B05C 1/083* (2013.01); *B05C 1/0813* (2013.01); *B05C 3/10* (2013.01);
(Continued)

(58) Field of Classification Search
None
See application file for complete search history.

(56) References Cited

U.S. PATENT DOCUMENTS 2,018,959 A * 10/1935 Jordhoy ..... B41F 31/022 101/363
3,352,317 A * 11/1967 Dahlgren ..... B41F 33/0054 101/148
(Continued)

FOREIGN PATENT DOCUMENTS

JP S59-52687 A 3/1984
JP H05-338398 A 12/1993
(Continued)

OTHER PUBLICATIONS

Apr. 1, 2014 International Search Report issued in International Patent Application No. PCT/JP2014/055799.
(Continued)

*Primary Examiner* — Binu Thomas
(74) *Attorney, Agent, or Firm* — Oliff PLC

(57) ABSTRACT

Activator applying device including a receiving pan that stores an activator for activation of a transfer film, and a spreading roller that rotates while being dipped in the activator in the receiving pan and applies the activator that has adhered to the surface thereof in a dip section of the activator applying device to the transfer pattern in a different section of the activator applying device. The activator is fed to the receiving pan in an amount greater than the amount of the activator applied to the transfer pattern, and an excessive
(Continued)

activator is discharged through a discharge port of the receiving pan. The activator is applied to the transfer pattern with the discharge port being located on the side where the activator is drawn up from the dip section, and the discharge port being located at the position of a streak caused by uneven dispersion of the additive pigment.

9 Claims, 5 Drawing Sheets

(51) Int. Cl.

| | |
|---|---|
| ***B41F 7/32*** | (2006.01) |
| ***B44C 1/175*** | (2006.01) |
| ***B05C 3/10*** | (2006.01) |
| *B41F 31/02* | (2006.01) |

(52) U.S. Cl.
CPC ..... *B05C 11/11* (2013.01); *B41F 7/32* (2013.01); *B44C 1/175* (2013.01); *B41F 31/022* (2013.01)

(56) References Cited

U.S. PATENT DOCUMENTS 3,936,549 A * 2/1976 Kohler ..... B05C 1/12 118/259
4,574,695 A * 3/1986 Ryan ..... B41F 7/32 101/148
5,101,761 A * 4/1992 Isowa ..... B05C 1/0813 118/249
5,280,750 A * 1/1994 Yoshida ..... B41F 31/08 101/363
6,807,905 B2 * 10/2004 Deslangle ..... B41F 7/32 101/147
2013/0208058 A1 * 8/2013 Suzuki ..... G03G 15/104 347/85
2015/0022600 A1 * 1/2015 Numata ..... B05C 1/0813 347/101

FOREIGN PATENT DOCUMENTS

| | | | |
|---|---|---|---|
| JP | H07-40527 | A | 2/1995 |
| JP | H08-258498 | A | 10/1996 |
| JP | 2000-262957 | A | 9/2000 |
| JP | 2003-236422 | A | 8/2003 |
| JP | 2008-213428 | A | 9/2008 |
| JP | 2011-156871 | A | 8/2011 |

OTHER PUBLICATIONS

May 16, 2017 Office Action issued in Chinese Patent Application No. 201480015063.2.

* cited by examiner

ACTIVATOR APPLYING DEVICE, HYDRAULIC TRANSFER APPARATUS INCORPORATING THE SAME ACTIVATOR APPLYING DEVICE, AND ARTICLE WITH HYDRAULICALLY TRANSFERRED PATTERN MANUFACTURED WITH THE SAME HYDRAULIC TRANSFER APPARATUS

TECHNICAL FIELD

The present invention relates to hydraulic transfer in which an activator is applied to the surface of a transfer film supported by floating on the surface of a transfer liquid, the transfer film having an appropriate transfer pattern of a transfer ink (a surface ink layer) formed thereon in advance, and the activator being to restore the transfer ink into its wet state, and a work piece is then pressed against the transfer film and dipped into the transfer liquid, so that the transfer pattern on the transfer film is transferred to the work piece by the action of the hydraulic pressure caused by the pressing. In particular, it relates to hydraulic transfer in which the activator contains an additive pigment, such as scales of pigment or a color pigment having a significantly different specific gravity.

The additive pigment described above may be a wide variety of pigments such as basic color pigments of red, yellow, blue, white and black and metallic lustrous pigments including metal powder or glittering pigments.

BACKGROUND ART

Hydraulic transfer is known in which a transfer film including a water-soluble film (carrier sheet) and an appropriate water-insoluble transfer pattern formed thereon in advance is placed on a transfer liquid (typically, water) in a transfer liquid tank to wet the transfer film (water-soluble film) with the transfer liquid, and a work piece is brought into contact with the transfer film and forced into the liquid in the transfer liquid tank to transfer the transfer pattern on the transfer film to the surface of the work piece by the action of the hydraulic pressure. The transfer film includes a water-soluble film and a transfer pattern of an ink formed (printed) thereon in advance as described above, and the ink of the transfer pattern is dry. Thus, in performing the transfer, a solvent or non-solvent activator needs to be applied to the transfer pattern on the transfer film to restore the transfer pattern into the same wet state as the transfer pattern immediately after printing, that is, a state where the transfer pattern has adhesion. This processing is called activation.

A known activation process is an activator applying process that involves using a spreading roller, such as a gravure roll coater or a kiss-touch roll coater. This process is to activate the ink before the transfer film is introduced (fed) into the transfer liquid tank.

Some hydraulic transfer techniques have been disclosed in which an additive pigment, such as a color pigment, is contained not only in the transfer pattern on the water-soluble film but also in the activator that dissolves the transfer ink, and the applicant has filed several patents for such techniques (see Patent Literatures 1 to 3, for example).

With such techniques, the additive pigment is disposed on the transfer ink of the transfer pattern (between the work piece and the transfer ink after transfer), while the shape of the transfer pattern is substantially unchanged, even though the transfer ink of the transfer pattern on the water-soluble film bulges out (expands) on the liquid surface because of the additive pigment contained in the activator. Thus, a wider variety of design elements (variations of color of the transfer pattern) can be imparted to the same transfer pattern.

An important advantage of this is that a wide variety of design elements can be provided by the color of the work piece itself or the color of the additive pigment in the activator without changing the transfer pattern on the water-soluble film (that is, without increasing the number of gravure printing plates).

However, the conventional techniques, that is, the techniques of imparting a wide variety of design elements by using the additive pigment contained in the activator can be used only when the additive pigment is uniformly added over the entire surface of the transfer pattern on the water-soluble film. In addition, those techniques have a problem that a difference or variation in color, grain size and blending of the additive pigment has a great effect on the desired design element (such an effect on the design element is referred to as a "streak", which will be described later) and therefore it is extremely difficult to handle the activator blended with the additive pigment.

In particular, if the additive pigment has a specific gravity different from that of a liquid constituent of the activator, it is necessary to maintain dispersion of the additive pigment in the activator from the viewpoint of design reproducibility. Even if dispersion of the additive pigment in the activator can be maintained, if a phenomenon called a streak occurs during application of the activator, a problem arises in that the streak has an effect on the design of the resulting article with a hydraulically transferred pattern, and the problem needs to be solved. This problem is marked if the additive pigment is a lustrous pigment that has a high luster.

More specifically, when the inventor performs hydraulic transfer using an activator containing a lustrous pigment having a high luster (a pigment containing many fine scale-shaped pieces of a metal) as an additive pigment, there arise problems in that the article with a hydraulically transferred pattern has a design element that provides unstable intense reflected light and that a pattern called a "streak" is accidentally formed.

In particular, in a mass production phase, the larger the scales of lustrous pigment is, or the greater the difference in specific gravity the pigment has, the more significantly the pigment settles down or the concentration of the pigment varies before activation, and the more marked the uncontrollable change in color design is.

Next, the "streak" will be described. The "streak" is a visible line of the additive pigment formed on the transfer film as a result of uneven dispersion of the additive pigment at a site where the content or concentration of the additive pigment in the activator adhering to the spreading roller significantly varies. The "streak" is a phenomenon that occurs irregularly and therefore has generally been handled as a defective design element.

A cause of occurrence of the "streak" is contact of the surface of the spreading roller with a liquid, for example. The occurrence probably involves various factors, such as the site of unevenness of the flow of the activator, the position of a bubble dwelling on the liquid surface or a bubble adhering to a part of the surface of the spreading roller, or the position where the excessive activator scrapped off by a doctor knife drops along the spreading roller.

CITATION LIST

Patent Literature

Patent Literature 1: Japanese Patent Laid-Open No. 59-52687 (Japanese Patent No. 1389115)
Patent Literature 2: Japanese Patent Laid-Open No. 5-338398 (Japanese Patent No. 3234992)
Patent Literature 3: Japanese Patent Laid-Open No. 8-258498

SUMMARY OF INVENTION

Technical Problem

The present invention has been devised in view of such circumstances. An object of the present invention is to develop a novel activator applying device and a hydraulic transfer method that positively control characteristics of an additive pigment or a flow of an activator to impart a desired design to a transfer pattern.

That is, on the assumption that an additive pigment contains an activator, the inventor has focused on an idea of positively using a streak as a design element by controlling the position of the streak while maintaining the dispersion of the additive pigment in the activator. More specifically, the inventor has found that the additive pigment has a scale-like shape or has a specific gravity significantly different from that of another constituent of the activator, so that various designs can be arbitrarily imparted to a same transfer pattern by adjusting the concentration, the state of settling down or the state of floating of the additive pigment in the activator or the flow of the activator on the side of an activator applying device during successive hydraulic transfers.

Solution to Problem

An activator applying device according to claim 1 is an activator applying device that applies an activator containing an additive pigment such as a scale of pigment or a color pigment having a different specific gravity to a transfer film, which includes a water-soluble film and a dry transfer pattern formed thereon, during transportation of the transfer film to a transfer liquid tank to activate the transfer pattern on the transfer film when the transfer film with the transfer pattern facing up is fed onto a surface of a liquid in the transfer liquid tank, a work piece is pressed against the transfer film from above, and the transfer pattern is transferred to the work piece by the action of a hydraulic pressure caused by the pressing, wherein the activator applying device comprises a receiving pan that stores the activator, and a spreading roller that rotates while being dipped in the activator in the receiving pan and applies the activator that has adhered to the surface thereof in a dip section of the activator applying device to the transfer pattern in a different section of the activator applying device, the activator is fed to the receiving pan in an amount greater than the amount of the activator applied to the transfer pattern, an excessive activator is discharged through a discharge port of the receiving pan, and the activator is applied to the transfer pattern with the discharge port being located on the side where the activator is drawn up from the dip section, and the discharge port being located at the position of a streak caused by uneven dispersion of the additive pigment.

An activator applying device according to claim 2 is the activator applying device according to claim 1, wherein an overflow tank adjacent to the receiving pan is used in discharging the activator from the receiving pan, and a screen wall that blocks an end part or a part of the discharge port through which the activator is discharged from the receiving pan into the overflow tank is provided at a position where a streak is desirably formed.

An activator applying device according to claim 3 is the activator applying device according to claim 2, wherein a doctor knife that makes the thickness of the activator applied to the transfer pattern uniform is provided at a circumferential surface of the spreading roller on the side where the activator is drawn up from the dip section, and the overflow tank is provided adjacent to a vertical wall of the receiving pan on the same side as the doctor knife.

An activator applying device according to claim 4 is the activator applying device according to claim 3, wherein a supply port through which the activator is fed to the receiving pan is provided on the same side as the doctor knife in plan view of the receiving pan.

An activator applying device according to claim 5 is the activator applying device according to claim 4, wherein an adjustment plate is attached to the receiving pan so as to be positioned in the activator stored in the receiving pan, the activator being applied to the transfer pattern in the state where the adjustment plate is attached to the receiving pan, and the adjustment plate is attached to the receiving pan so as to be positioned between the supply port of the receiving pan and the spreading roller in side view.

An activator applying device according to claim 6 is the activator applying device according to claim 5, wherein the adjustment plate has a rectifying function of isolating or separating a flow of the activator above the adjustment plate that is drawn up mainly along the circumferential surface of the spreading roller and a flow of the activator below the adjustment plate that is fed to the receiving pan.

An activator applying device according to claim 7 is the activator applying device according to claim 1, 2, 3, 4, 5 or 6, wherein the discharge port through which the activator is discharged from the receiving pan has an opening dimension equal to or greater than the width of the transfer film.

An activator applying device according to claim 8 is the activator applying device according to claim 1, 2, 3, 4, 5, 6 or 7, wherein the dimension in the width direction and the position of the opening of the discharge port through which the activator is discharged from the receiving pan is able to be adjusted as required.

A hydraulic transfer apparatus according to claim 9 is a hydraulic transfer apparatus, comprising:

a transfer liquid tank that stores a transfer liquid;

a transfer film feeding device that feeds a transfer film to the transfer liquid tank;

an activator applying device that applies an activator containing an additive pigment such as a scale of pigment or a color pigment having a different specific gravity to the transfer film yet to be fed onto a surface of a liquid in the transfer liquid tank to activate a transfer pattern on the transfer film; and a work piece conveying device that presses a work piece against the transfer film fed onto the surface of the liquid in the transfer liquid tank from above, the transfer film including a water-soluble film and a dry transfer pattern formed thereon and being supported by floating on the surface of the liquid in the transfer liquid tank, the work piece being pressed against the transfer film from above, and the transfer pattern being transferred to the work piece by the action of a hydraulic pressure caused by the pressing, wherein the activator applying device is the activator applying device according to claim 1, 2, 3, 4, 5, 6, 7 or 8.

An article with a hydraulically transferred pattern according to claim 10 is an article with a hydraulically transferred pattern manufactured by feeding a transfer film including a water-soluble film and a dry transfer pattern formed thereon with the transfer pattern facing up onto a surface of a liquid in a transfer liquid tank, pressing a work piece against the transfer film from above, and transferring the transfer pattern to the work piece by the action of a hydraulic pressure caused by the pressing, wherein the article with a hydraulically transferred pattern is produced by the hydraulic transfer apparatus according to claim 9.

Advantageous Effects of Invention

The problem described above is solved by means of the configuration of the present invention set forth in each claim.

According to the inventions according to claims 1, 9 and 10, the discharge port through which the activator is discharged from the receiving pan is located at a position where a streak is desirably formed, thereby intentionally forming a streak. Therefore, such a streak can be positively used as a design element of the article with a hydraulically transferred pattern. At an end of the discharge port, the flow of the activator is intentionally changed to form a streak in the vicinity of the end of the discharge port (including the screen wall described later).

In the case where the whole (the entire width) of the transfer pattern on the transfer film is not transferred to the work piece, but only a part of the transfer pattern (which is referred to as an effective transfer part) is transferred to the work piece, the discharge port can be aligned with a part outside of the effective transfer part, thereby avoiding forming a streak on a design surface of the work piece (article with a hydraulically transferred pattern) (that is, a streak can be formed at a part outside the effective transfer part).

According to the inventions according to claims 2, 9 and 10, an overflow mechanism is used in discharging the activator from the receiving pan, so that the additive pigment having a high specific gravity can be effectively prevented from settling down in the activator in the receiving pan, and the additive pigment can be positively introduced to the site of overflow to form a thick streak. In addition, if the activator in the overflow tank is collected at the bottom thereof, for example, the additive pigment that tends to settle down in the overflow tank can be efficiently collected.

According to the inventions according to claims 3, 9 and 10, the overflow tank is provided adjacent to the vertical wall of the receiving pan on the same side as the doctor knife. Therefore, the flow of the dropping activator scraped off by the doctor knife (the flow of an excessive liquid dropping on the outer side of the flow of the liquid adhering to and drawn up by the rotating spreading roller) can be quickly guided on the liquid surface in the direction away from the spreading roller and smoothly collected in the overflow tank. Thus, occurrence of a disturbance on the liquid surface caused by the flow of the dropping liquid can be effectively prevented.

According to the inventions according to claims 4, 9 and 10, the supply port through which the activator is fed to the receiving pan is provided on the same side as the doctor knife in plan view. Thus, the activator can flow substantially in parallel to the spreading roller, and the additive pigment can be stably dispersed in the surface of the activator in the receiving pan, in particular, in the surface of the liquid on the side of the doctor knife.

According to the inventions according to claims 5, 9 and 10, the adjustment plate is provided between the supply port and the spreading roller. Thus, the adjustment plate can catch a bubble that occurs in the activator, in particular, a bubble that can occur when the activator is fed to the receiving pan and prevent the bubble from floating up and adhering to the spreading roller.

According to the inventions according to claims 6, 9 and 10, the adjustment plate has a rectifying function and therefore can isolate or separate the flow of the activator along the circumferential surface of the spreading roller (the flow of the activator mainly adhering to and drawn up by the spreading roller) and the flow of the activator fed to the receiving pan (the flow along the spreading roller). Thus, in the receiving pan, these different flows can be prevented from strongly colliding (merging) with each other, so that the flows of the activator can be stabilized (the so-called rectifying function), and therefore, the surface of the liquid can also be stabilized.

More specifically, as the spreading roller rotates, a flow of the activator in the direction of the rotation is formed in the vicinity of the roller. Since the activator is partitioned by the adjustment plate, the liquid flow caused by the rotation of the roller can be prevented from being disturbed. Below the adjustment plate, a different flow of the newly introduced activator can be formed without disturbing the liquid flow.

According to the inventions according to claims 7, 9 and 10, the discharge port of the receiving pan at which a streak is formed has a dimension equal to or greater than the width of the transfer film. Thus, an expression of design is possible in which no streak is formed substantially over the entire width (entire area) of the transfer pattern.

According to the inventions according to claims 8, 9 and 10, the dimension in the width direction and the position of the opening of the discharge port of the receiving pan can be adjusted as required. Thus, the position, size or the like of the streak formed on the transfer pattern can be appropriately determined, and the article with a hydraulically transferred pattern can be improved in design.

DESCRIPTION OF EMBODIMENTS

Modes for carrying out the present invention include not only the embodiment described below but also various improvements that can be made without departing from the technical idea thereof.

In the following, a transfer film F to which the present invention is applied will be first described. The general configuration of a hydraulic transfer apparatus 1 and an activator applying device 4 will then be described.

EMBODIMENT

First, the transfer film F will be described. The transfer film F may be any well-known, commercially available transfer film.

In hydraulic transfer, not only a simple transfer pattern but also a transfer pattern having a surface protective capability can be transferred to a work piece W (such a transfer pattern will be referred to as a "transfer pattern with a surface protective capability" hereinafter). The latter is intended for omission of a top coat, which is conventionally applied after transfer. That is, in the hydraulic transfer that involves imparting the surface protective capability, the work piece W with a transferred pattern is irradiated with active energy rays, such as ultraviolet rays or electron beam, to harden the transfer pattern formed by the hydraulic transfer to protect the surface of the transfer pattern. Of course, a top coat can further be applied to the transfer pattern with a surface protective capability.

As the transfer film F, a water-soluble film (such as of polyvinyl alcohol (PVA)) with only a transfer pattern of a transfer ink formed thereon, or a water-soluble film with a transfer pattern and a curable resin layer formed between the film and the transfer pattern can be used. In particular, if the transfer film F is a water-soluble film with only a transfer pattern formed thereon, a curable resin composition in the liquid state is used as an activator. As the curable resin composition, an ultraviolet-curable or electron beam-curable resin composition containing a photo-polymerizable monomer is preferable.

Of course, when the transfer film F is a water-soluble film with only a transfer pattern formed thereon, the surface protective capability may not be imparted to the transfer film F in the hydraulic transfer. And in that case, a normal top coat can be applied to protect the surface of the transfer pattern.

As the transfer pattern, any conventionally well-known, commercially available pattern is possible. That is, the transfer pattern may be a camouflage pattern, a woodgrain pattern, a metallic (lustrous) pattern, a rock-grain pattern that imitates the surface of a rock such as a marble pattern, a textile pattern that imitates cloth or fabric, a tile pattern, a brick pattern, a geometrical pattern, a holographic pattern or an appropriate combination thereof. The geometrical pattern described above may contain not only graphics but also characters or pictures.

Figure 1:
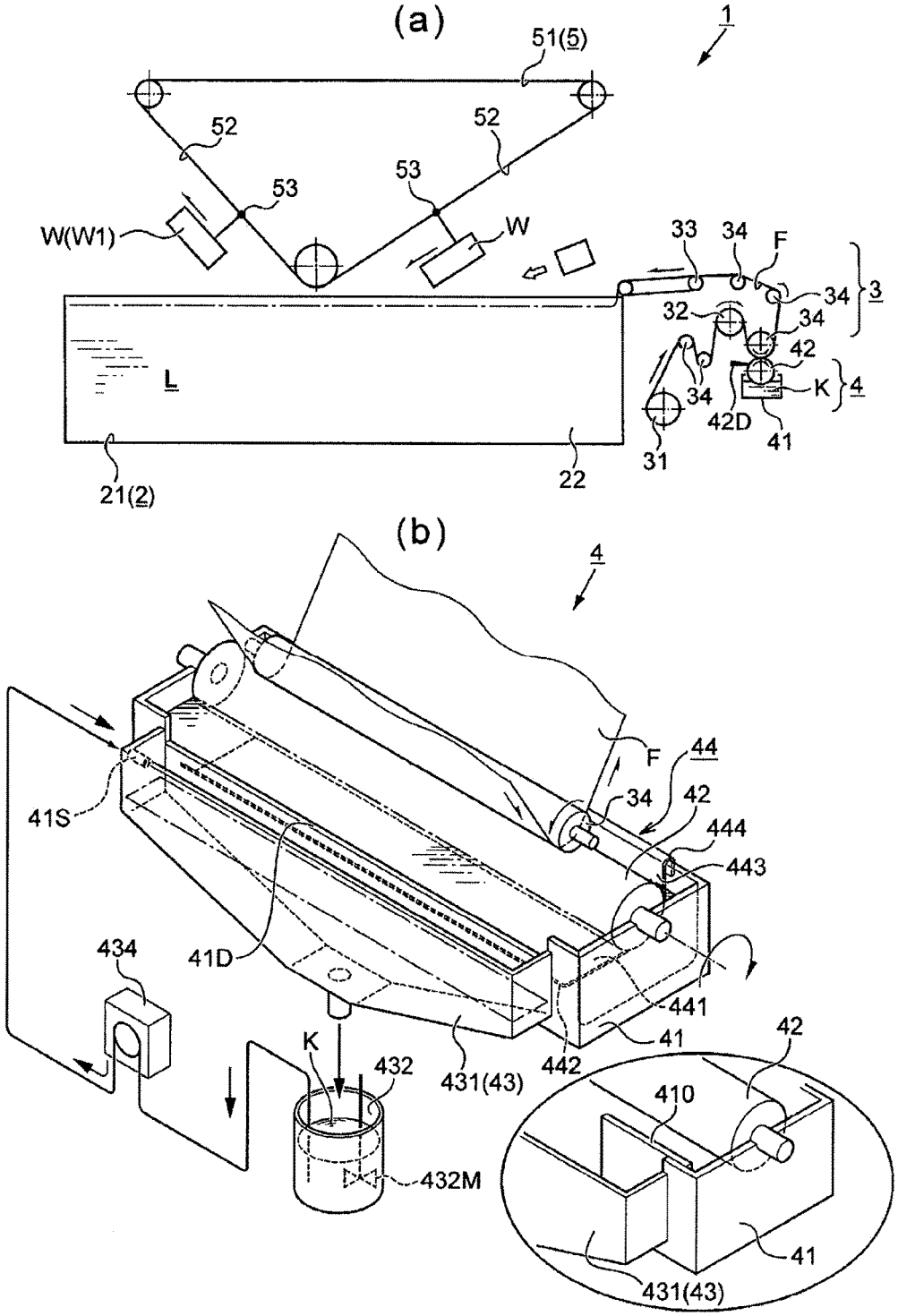
FIG. 1(*a*) is a skeletal side view showing an example of a hydraulic transfer apparatus that incorporates an activator applying device according to the present invention, and FIG. 1(*b*) is a perspective view of the activator applying device.

Next, the hydraulic transfer apparatus 1 will be described. As shown in FIG. 1(*a*) as an example, the hydraulic transfer apparatus 1 comprises a transfer liquid tank 2 that stores a transfer liquid L, a transfer film feeding device 3 that feeds the transfer film F to the transfer liquid tank 2, an activator applying device 4 for making the transfer film F active and transferable, and a work piece conveying device 5 that puts the work piece W in an appropriate position onto the transfer film F supported by floating on the transfer liquid in the transfer liquid tank 2 from above the transfer film F (or dips the work piece W into the transfer liquid) and removes the work piece W from the transfer liquid (or removes the work piece W out of the transfer liquid).

According to the present invention, an activator K that activates the transfer ink of the transfer pattern contains an additive pigment such as scales of pigment (metallic lustrous pigment) or a color pigment having a significantly different specific gravity. The activator applying device 4 applies the activator K containing such an additive pigment to the transfer film (transfer pattern).

In the following, individual components of the hydraulic transfer apparatus 1 will be described.

First, the transfer liquid tank 2 will be described. The transfer liquid tank 2 is to support the transfer film F in hydraulic transfer in such a manner that the transfer film F floats on the transfer liquid and primarily comprises a processing tank 21 that stores the transfer liquid L at a substantially constant liquid level (water level). To this end, the processing tank 21 is open at the top and has a bottom and a front, a rear, a left and a right wall. In particular, both left and right side walls of the processing tank 21 are denoted by reference numeral 22.

In the processing tank 21, the transfer liquid L flows in the vicinity of the liquid surface from a film feeding side (upstream side) to a liquid discharge area (downstream side). More specifically, for example, an overflow tank is provided in the vicinity of the downstream end of the transfer liquid tank 2, and the transfer liquid L collected in the overflow tank is fed back to the upstream side of the transfer liquid tank 2 through a circulation pipe and then fed again primarily to the upstream part of the transfer liquid tank 2, thereby forming the flow of the transfer liquid L in the vicinity of the liquid surface. Of course, a purifying device, such as a settling tank or a filter, can be provided in the circulation pipe to remove contaminants, such as an excessive film or remains of the film, dispersed or residing in the transfer liquid L from the collected liquid (suspension).

A chain conveyer serving as a film holding mechanism is provided on the inside of each side wall 22 of the processing tank 21. The chain conveyers hold the transfer film F fed onto the liquid surface at the both sides to convey the transfer film F from the upstream side to the downstream side at the same velocity as the flow of the transfer liquid L. Of course, the transfer film F (in particular, a water-soluble film) fed onto the transfer liquid surface tends to gradually expand (spread) in every direction once placed on the transfer liquid, and the film holding mechanism (chain conveyers) serves also to restrict the expansion of the transfer film F at the both sides. That is, the film holding mechanism serves to convey the transfer film F at least to a dip area (transfer point) while restricting the expansion thereof to a substantially fixed extent. Thus, the expansion of the transfer film F at the transfer point is restricted to the same extent in each transfer, and precise transfer can be repeated.

Next, the transfer film feeding device 3 will be described. As shown in FIG. 1(*a*) as an example, the transfer film feeding device 3 comprises a film roll 31, which is a roll of the transfer film F, a heat roller 32 that heats the transfer film F unrolled from the film roll 31, and a guide conveyer 33 that feeds the transfer film F to the transfer liquid tank 2. The transfer film F is fed to the transfer liquid tank 2 via these components by guide rollers 34.

In this embodiment, the rolled transfer film F (film roll 31) is not cut and continuously fed to the transfer liquid tank 2. Alternatively, however, the transfer film F may be cut in appropriate lengths after the activator is applied to the transfer film F, and the cut sheets of the transfer film F may be fed one by one to the transfer liquid tank 2.

Next, the activator applying device 4 according to the present invention will be described. The activator applying device 4 is to apply the activator K containing an additive pigment to the transfer pattern on the transfer film F and is provided in a subsequent stage of the heat roller 32 of the transfer film feeding device 3 as shown in FIG. 1 as an example.

In this example, the activator applying device 4 applies the activator K to the transfer pattern in roller coating (process). This process involves letting the activator K adhere to the surface (circumferential surface) of a rotating spreading roller and applying the activator K on the surface of the spreading roller to the transfer pattern.

To this end, the activator applying device 4 primarily comprises a receiving pan 41 that stores the activator K and a spreading roller 42 that rotates while being dipped in the activator K stored in the receiving pan 41. The activator K adheres to the surface of the spreading roller 42 in a dip section of the activator applying device 4 in which the spreading roller 42 is dipped in the activator K, and is applied to the transfer pattern in a non-dip section.

Figure 2:
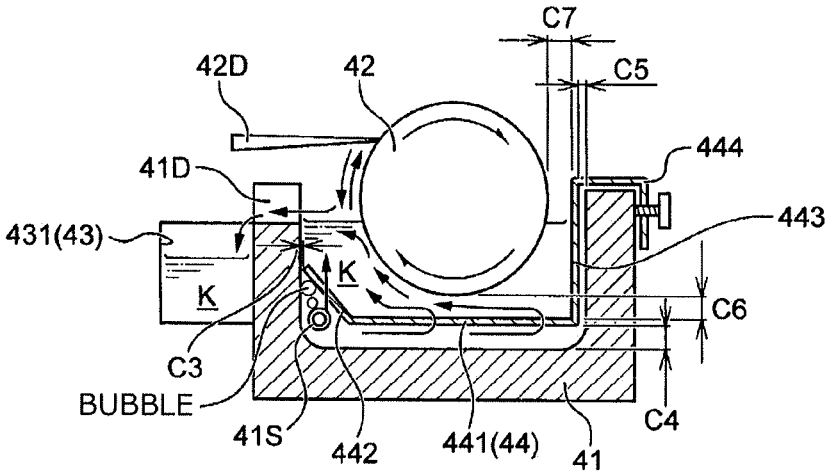
FIG. 2 is a skeletal side view of the activator applying device.

As shown in FIG. 2 as an example, a doctor knife (doctor blade) 42D is provided to abut against the circumferential surface of the spreading roller 42 on the side where the activator K is drawn up from the dip section. The doctor knife is to scrape off any excess of the activator K adhering to the circumferential surface of the spreading roller to make the thickness of the activator K applied to the transfer pattern uniform.

In this drawing, the inner one of the arrows shown below the doctor knife 42D along the circumferential surface of the spreading roller 42 indicates the flow of the activator K that adheres to the circumferential surface of the spreading roller 42 and is drawn up from the dip section (the storage section for the activator K). In the same drawing, the outer one of the arrows shown along the circumferential surface of the spreading roller 42 indicates the flow of the excess of the activator K scrapped off by the doctor knife 42D (the flow of the dropping liquid). These flows will be referred to generically as a "flow along the circumferential surface of the spreading roller 42".

According to the present invention, the activator K contains an additive pigment (scales of pigment or a color pigment having a significantly different specific gravity) as described above, and the additive pigment is prevented from settling down in the activator K (in the receiving pan 41) (that is, the additive pigment is dispersed in the activator K).

More specifically, during application of the activator K, the activator K is constantly fed (supplied) to the receiving pan 41 and at the same time constantly discharged from the receiving pan 41. In this way, a gentle flow of the activator K is formed in the receiving pan 41 to prevent the additive pigment from settling down in the receiving pan 41 (activator K).

In this respect, with a common roll coater, after a certain amount of activator K is fed (put) into the receiving pan 41 at the start of transfer, the activator K is not supplied nor discharged during application of the activator K. Therefore, if the activator K containing an additive pigment is applied in the conventional process, the additive pigment settles down on the bottom of the receiving pan 41 some time after the start of the operation, so that constituents of the activator other than the additive pigment are applied to the transfer pattern, and the additive pigment cannot be applied to the transfer pattern.

In view of this, in addition to the receiving pan 41 and the spreading roller 42, in particular, the activator applying device 4 according to the present invention comprises an additive pigment dispersing mechanism 43 that prevents the additive pigment from settling down in the activator K in the receiving pan 41 and an adjustment plate 44 that is provided in the activator K in the receiving pan 41. In the following, the additive pigment dispersing mechanism 43 and the adjustment plate 44 will be further descried.

First, the additive pigment dispersing mechanism 43 will be described.

The additive pigment dispersing mechanism 43 supplies the activator K to the receiving pan 41 and at the same time discharges the activator K from the receiving pan 41 as described above, thereby forming a gentle flow of the activator K in the receiving pan 41 to disperse the additive pigment (that is, to prevent the additive pigment from settling down). According to this embodiment, the operation of supplying the activator K to the receiving pan 41 and at the same time discharging the activator K from the receiving pan 41 involves circulating the activator K in the receiving pan 41. That is, according to this embodiment, the receiving pan 41 is provided in a closed-loop circulation path, and the activator K removed from the receiving pan 41 is circulated and fed back to the receiving pan 41.

More specifically, as shown in FIG. 1(*b*) as an example, the additive pigment dispersing mechanism 43 according to this embodiment comprises an overflow tank 431 that is provided adjacent to the receiving pan 41 along the longitudinal direction thereof (that is, along the direction of the rotational axis of the spreading roller 42) (at the vertical wall of the receiving pan 41 on the same side as the doctor knife 42D), a collection tank 432 that stores the activator K discharged from the overflow tank 431, and a supply pump 434 that feeds the activator K in the collection tank 432 back to the receiving pan 41.

The amount of the activator K fed back to the receiving pan 41 (supply amount) is equal to or greater than the amount of the activator K applied to the transfer pattern.

Figure 5:
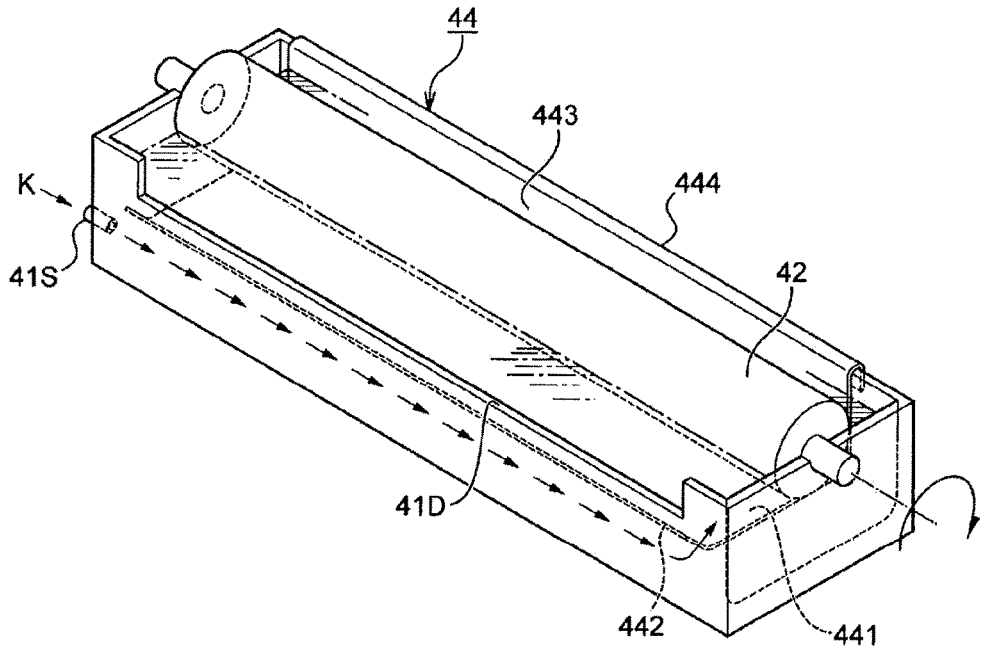
FIG. 5 is a skeletal perspective view primarily showing a receiving pan of the activator applying device.

The receiving pan 41 is provided with a supply port 41S through which the activator K from the collection tank 432 is supplied to the receiving pan 41. As shown in FIGS. 2 and 5 as an example, the supply port 41S is provided at one end of the receiving pan 41, so that the activator K flows along the spreading roller (the rotational axis thereof) 42 when the activator K is supplied to the receiving pan 41 through the supply port 41S.

In plan view of the receiving pan 41, the supply port 41S of the receiving pan 41 is provided on the same side as the doctor knife 42D.

Furthermore, a discharge port 41D through which the activator K is discharged to the overflow tank 431 is formed in the vertical wall of the receiving pan 41 on the side of the doctor knife 42D. According to this embodiment, since the activator K is discharged by overflow, the discharge port 41D has a weir-like shape as shown in FIG. 1(*b*) as an example.

The primary purpose of discharging the activator K in the receiving pan 41 to the overflow tank 431 through the discharge port 41D is to cause a flow of the activator K and prevent the additive pigment from settling down in the activator K (in the receiving pan 41). However, such an overflow mechanism serves also to keep the liquid level of the activator K in the receiving pan 41 at substantially constant and contributes to stabilization of the amount of the activator K adhering to the circumferential surface of the spreading roller 42 and thus stabilization of the operation of applying the activator K.

When the activator K is collected from the overflow tank 431, the activator K is preferably collected at the bottom (lowermost part) of the overflow tank 431 as shown in FIG. 1(*b*) as an example in order to surely collect the additive pigment, which tends to settle down in the overflow tank 431.

Furthermore, the flow (liquid flow) of the activator K is intentionally changed near the ends of the discharge port 41D of the receiving pan 41, thereby forming a streak on the transfer pattern at positions corresponding to the ends of the discharge port 41D, that is, at positions in the width direction of the transfer film F that correspond to the ends of the discharge port 41D. The streaks can be controlled by adjusting the positions of the ends of the discharge port 41D (that is, the dimension or position in the width direction of the opening of the discharge port 41D), so that the streaks can be positively used as an expression of design, for example.

Of course, as shown in FIG. 1(*b*), for example, if the discharge port 41D of the receiving pan 41 is formed wider than the transfer film F (transfer pattern) to which the activator K is to be applied (that is, if the dimension in the width direction of the opening is greater than the width of the transfer film F), the streaks at the ends of the discharge port 41D lie outside the transfer pattern, so that occurrence of a streak can be prevented over the entire width of the transfer pattern.

In view of this, the dimension and position in the width direction of the opening of the discharge port 41D of the receiving pan 41 are preferably adjustable (variable). More specifically, as also shown in FIG. 1(*b*), if the discharge port 41D has a large opening width, and it is desirable to adjust the opening width of the discharge port 41D (such as in the case where it is desirable to appropriately reduce the opening width), the discharge port 41D can be partially blocked by a screen wall 410. Of course, the screen wall 410 is preferably able to be attached to and detached from the receiving pan 41 (discharge port 41D) with a single motion.

If it is only required to change the position of the discharge port 41D, the receiving pan 41 can be moved with respect to the transfer film F, for example.

The means for discharging the activator K from the receiving pan 41 is not necessarily limited to the overflow mechanism, and any other collection mechanism is possible. For example, a vacuum mechanism that sucks the activator K near the liquid surface can be used. In that case, a suction nozzle is provided instead of the overflow tank 431 described above.

Next, the collection tank 432 and the supply pump 434 will be described.

As described above, the collection tank 432 is a component that collects and stores the activator K removed from the overflow tank 431. As shown in FIG. 1, for example, the collection tank 432 is preferably provided with an impeller 432M, which constantly agitates the activator K stored in the tank to disperse the additive pigment with higher reliability.

The supply pump 434 is used to remove the activator K from the collection tank 432 and feed the activator K back to the receiving pan 41. The supply pump 434 is preferably a tube pump, for example, since the tube pump eliminates the possibility of entry of foreign matter into the activator K to be transported.

The embodiment shown in FIG. 1(*b*) is based on the assumption that the activator K is collected from the overflow tank 431 by gravity drop, so that any pump or the like is not provided between the overflow tank 431 and the collection tank 432. However, if the collection tank 432 is located at a higher level than the overflow tank 431, a pump (such as a tube pump) or the like is provided between the overflow tank 431 and the collection tank 432. Of course, even in the embodiment based on the assumption that the activator K is collected by gravity, a pump for collection can be provided between the overflow tank 431 and the collection tank 432. In that case, the activator K can be collected in a shorter time with higher reliability.

Furthermore, according to this embodiment, the activator K is fed (supplied) to the receiving pan 41 and at the same time discharged from the receiving pan 41 by circulating the activator K as described above. However, the present invention is not necessarily limited to this implementation. For example, in addition to the collection tank 432 that stores the activator K removed from the overflow tank 431, another tank used for supplying the activator K to the receiving pan 41 can be provided, and the activator collection section and the activator supply section can operate independently. In that case, the supply section that supplies the activator K to the receiving pan 41 and the collection section that discharges the activator K from the receiving pan 41 form separate discontinuous paths (that is, non-loop paths).

Next, the adjustment plate 44 will be described.

The adjustment plate 44 is provided in the receiving pan 41 (that is, in the activator K) as described above, and primarily has a function of catching a bubble that can occur in the activator K (this function will be referred to as a bubble holding function) and a function of rectifying the flow (liquid flow) of the activator K in the receiving pan 41 (this function will be referred to as a rectifying function).

The "bubble" of the term "bubble holding function" means a bubble that occurs in the activator K, in particular, a bubble that occurs when the activator K is supplied to the receiving pan 41, and the bubble holding function is to catch such a bubble in the activator K and prevent the bubble from floating up and adhering to the spreading roller 42. If a bubble occurs in the activator K, the bubble tends to float up and adhere to the spreading roller 42 and partially inhibit application of the activator K (additive pigment) to the transfer pattern.

Figure 3:
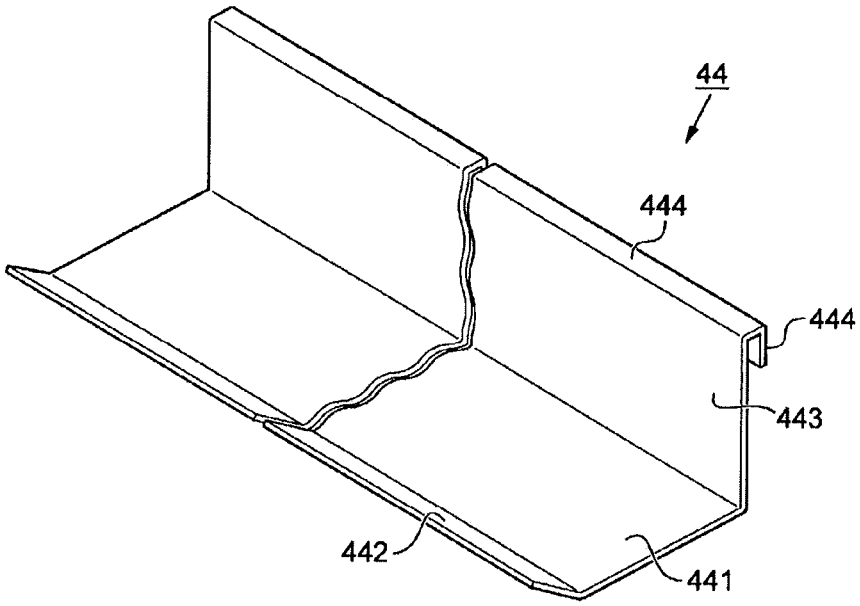
FIG. 3 is a perspective view of an adjustment plate of the activator applying device.

The "rectifying function" of the adjustment plate 44 is to isolate or separate the flows of the activator K along the circumferential surface of the spreading roller 42 (the flow of the activator K adhering to the circumferential surface of the spreading roller 42 and drawn up from the dip section and the flow of the activator K scrapped off by the doctor knife 42D) and the flow of the activator K fed (supplied) to the receiving pan 41 from each other to prevent these different flows from strongly merging (colliding) with each other as far as possible As shown in FIGS. 2 and 3 as an example, the adjustment plate 44 having these functions comprises a bottom surface part 441 that is substantially parallel to the bottom surface of the receiving pan 41 when the adjustment plate 44 is attached to the receiving pan 41, an inclined surface part 442 and a raised surface part 443 formed to the front and the rear of the bottom surface part 441, and an engagement part 444 at which the adjustment plate 44 is attached (fixed) to the receiving pan 41. In the following, the individual parts of the adjustment plate 44 will be further described.

First, the bottom surface part 441 is a surface part that is positioned substantially along the bottom surface of the receiving pan 41 when the adjustment plate 44 is attached to the receiving pan 41 as described above. The bottom surface part 441 is positioned not to abut against (come into contact with) the bottom surface of the receiving pan 41. Thus, in the receiving pan 41, the activator K below the spreading roller 42 is vertically partitioned or divided by the bottom surface part 441.

Next, the inclined surface part 442 will be described. The inclined surface part 442 is an inclined part with a raised front edge that is continuously formed to the front of the bottom surface part 441 (on the same side as the doctor knife 42D in plan view). As shown in FIG. 2 as an example, the supply port 41S is positioned below the inclined surface part 442. That is, the partition below the bottom surface part 441 and the inclined surface part 442 is a partition in which the activator K supplied to the receiving pan 41 through the supply port 41S mainly flows (a partition in which the activator K flows in a direction substantially parallel to the axial direction of the spreading roller 42), and the partition above the bottom surface part 441 and the inclined surface part 442 is a partition in which the activator K mainly flows along the circumferential surface of the spreading roller 42. In other words, the bottom surface part 441 and the inclined surface part 442 serve to separate the flows of the activator K in the receiving pan 41 to stabilize the flows of the activator K. Thus, strong collision of the flows of the activator K and occurrence of a streak caused thereby are prevented. Since the flows of the activator K are stabilized, the surface of the activator K in the receiving pan 41 is also stabilized.

Furthermore, the front edge of the inclined surface part 442 is positioned to abut against the front vertical wall of the receiving pan 41 (that is, there is substantially no clearance between the inclined surface part 442 and the front vertical wall of the receiving pan 41) when the adjustment plate 44 is attached to the receiving pan 41. Because of this, and because the activator K flows as described above, a bubble that can occur in the liquid when the activator K is fed to the receiving pan 41 is caught below (prevented from floating up by) the front edge of the inclined surface part 442.

Next, the raised surface part 443 and the engagement part 444 will be described.

The raised surface part 443 is a substantially vertical surface part that is continuously formed to the rear of the bottom surface part 441 (on the opposite side to the doctor knife 42D and to the inclined surface part 442 in plan view). The raised surface part 443 is positioned substantially parallel to the rear vertical wall of the receiving pan 41 (with a clearance of approximately 2 mm therebetween, for example) when the adjustment plate 44 is attached to the receiving pan 41.

The engagement part 444 is a part that is formed by bending downward an upper edge part of the raised surface part 443 into a hook-like shape in lateral cross section (see FIG. 2). The engagement part 444 is hooked on the rear vertical wall of the receiving pan 41 to attach and fix the adjustment plate 44 to the receiving pan 41. An attachment/detachment hole (such as a threaded hole) is preferably formed in the engagement part 444. For example, the hole is used to attach (fix) the adjustment plate 44 to the receiving pan 41 with a screw. With such a detachable fixing mechanism, the adjustment plate 44 can be easily removed from the receiving pan 41 for maintenance or the like, and the workability is improved.

Next, the work piece conveying device 5 will be described. The work piece conveying device 5 is to dip the work piece W in an appropriate position into the transfer liquid L and remove the work piece W out of the transfer liquid L. Since the work piece W is attached to the work piece conveying device 5 with a transfer jig (referred to simply as a "jig", hereinafter), the work piece conveying device 5 according to this embodiment also comprises a conveyer 51 having a conveyance function and a jig holder. That is, in hydraulic transfer, the work piece W is attached to the jig in advance, and the jig is attached to the jig holder, thereby attaching the work piece W to the conveyer 51. In the following, the conveyer 51 will be further described.

As shown in FIG. 1(*a*) as an example, the conveyer 51 comprises a pair of link chains 52 provided parallel to the sides of the transfer liquid tank 2 (transfer film F), link bars 53 spanning the pair of link chains 52 at predetermined intervals, and jig holders attached to the link bars 53. The work piece conveying device 5 is configured to successively dip the jigs and the work pieces W into the transfer liquid L and remove them from the transfer liquid L. Attachment of the work piece W (jig) to the conveyer 51 before dipping and removal of the work piece W (jig) from the conveyer 51 after transfer and removal from the transfer liquid L may be performed automatically by a robot or manually by an operator. The speed of conveyance of the work piece W by the conveyer 51 (in particular, the speed in the dip area) is typically set to be equal to the speed of transportation of the transfer film F on the transfer liquid L (that is, the speed of the flow of the transfer liquid L).

As shown in FIG. 1(*a*), the conveyer 51 according to this embodiment is a triangle conveyer having an inverted triangle-shaped conveyance track in side view. However, the shape of the conveyance track is not necessarily limited to triangle, and the conveyance track can have any shape such as a trapezoid (rectangle).

The work piece conveying device 5 is not necessarily limited to the conveyer 51 but may be an articulated robot (a so-called manipulator).

The hydraulic transfer apparatus 1 incorporating the activator applying device 4 according to the present invention has the basic configuration described above. In the following, how the activator K is applied and how the activator K flows in the receiving pan 41 will be described.

In hydraulic transfer, the transfer film F is fed to the transfer liquid tank 2 via the guide rollers 34, the heat roller 32 and the like as described above. In particular, according to this embodiment, the transfer film F is appropriately heated by the heat roller 32, the activator K is applied to the transfer film F, and then the transfer film F is fed to the transfer liquid tank 2.

As shown in FIG. 1(*b*) as an example, in a way of applying the activator K to the transfer film F, the spreading roller 42 rotates while being dipped in the activator K in the receiving pan 41, and the spreading roller 42 applies the activator K that has adhered to the circumferential surface thereof in the dip section of the activator applying device 4 to the transfer pattern in the non-dip section of the activator applying device 4. The doctor knife 42D is provided to abut against the circumferential surface of the spreading roller 42 (at a position immediately before the activator K is applied to the transfer pattern), in order to make the thickness of the activator K applied to the transfer pattern uniform.

The present invention is based on the assumption that the activator K contains an additive pigment, so that a gentle flow of the activator K is formed in the receiving pan 41 to prevent the additive pigment in the activator K from settling down. In the following, such a flow of the activator K in the receiving pan 41 will be described.

In the description below, clearances between various components in the state where the adjustment plate 44 is attached to the receiving pan 41 will be first described.

[Clearances Between Adjustment Plate and Receiving Pan]

Figure 4:
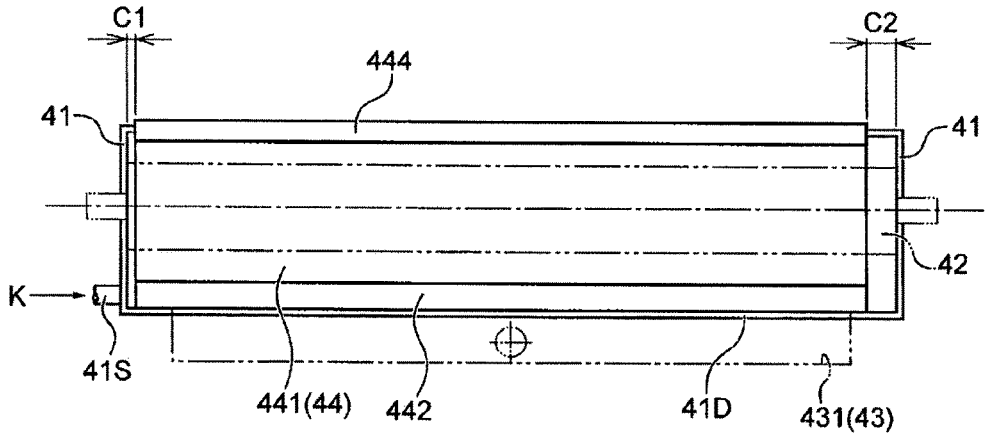
FIG. 4 is a skeletal plan view of the activator applying device.

A clearance at one end of the supply port 41S (a clearance between the adjustment plate 44 and the receiving pan 41) C1 is 0.5 mm in plan view as shown in FIG. 4 as an example. A clearance C2 at the opposite end of the supply port 41S is 5 mm in plan view as also shown in the same drawing as an example.

A clearance C3 between the front edge of the inclined surface part 442 of the adjustment plate 44 and the front vertical wall of the receiving pan 41 is 0 mm in side view (see FIG. 2). Furthermore, a clearance C4 between the bottom surface part 441 of the adjustment plate 44 and the bottom surface of the receiving pan 41 is 10 mm in side view as shown in FIG. 2 as an example, so that the adjustment plate 44 (bottom surface part 441) does not abut against the bottom of the receiving pan 41 when the adjustment plate 44 is attached to the receiving pan 41. A clearance C5 between the raised surface part 443 of the adjustment plate 44 and the rear vertical wall of the receiving pan 41 is 2 mm in side view as also shown in the same drawing as an example, so that the adjustment plate 44 (raised surface part 443) does not abut against the rear vertical wall of the receiving pan 41 when the adjustment plate 44 is attached to the receiving pan 41.

[Clearances Between Adjustment Plate and Spreading Roller]

A clearance C6 between the bottom surface part 441 of the adjustment plate 44 and the spreading roller 42 is set at 10 mm in side view as shown in FIG. 2 as an example. A clearance C7 between the raised surface part 443 of the adjustment plate 44 and the spreading roller 42 is set at 15 mm in side view as shown in the same drawing as an example.

With the configuration of the adjustment 44, the way of attachment thereof (including the dimensions of the clearances) and the like, the activator K fed to the receiving pan 41 through the supply port 41S mainly flows below the inclined surface part 442 (or the bottom surface part 441) of the adjustment plate 44 along the spreading roller 42 (the rotational axis thereof) (toward to the opposite end) as shown in FIG. 5 as an example. The activator K then flows up toward the spreading roller 42 at the opposite end where there is a relatively wide clearance. That is, through the clearance, the activator K flows upward over the side edge of the inclined surface part 442 (or the bottom surface part 441) (see FIG. 2).

Of course, the clearance at the end where the supply port 41S is provided is not set at 0 mm, even though it is relatively small. Therefore, immediately after the activator K is fed to the receiving pan 41, a small amount of the activator K can flow upward through the clearance over the side edge of the inclined surface part 442 (or the bottom surface part 441). On the whole, however, the activator K fed to the receiving pan 41 flows toward the opposite end along the spreading roller 42 (the rotational axis thereof) as described above.

In this process, according to this embodiment, as described above, the adjustment plate 44 provided in the activator K in the receiving pan 41 serves to isolate or separate the flow of the activator K along the spreading roller 42 (a parallel introduced flow) and the flow of the activator K along the circumferential surface of the spreading roller 42 above the adjustment plate 44 (a circumferential flow), thereby preventing these flows from strongly merging (colliding) with each other. Thus, in the receiving pan 41, a gentle flow (convection) of the activator K is formed.

According to this embodiment, as described above, since the clearance between the front edge of the inclined surface part 442 of the adjustment plate 44 and the front vertical wall of the receiving pan 41 is set at 0 mm (the front edge of the inclined surface part 442 abuts against the receiving pan 41), a bubble that occurs in the activator K, in particular, a bubble that occurs when the activator K is fed to the receiving pan 41 through the supply port 41S can be caught by the inclined surface part 442 and prevented from floating up and adhering to the spreading roller 42, as shown in FIG. 2 as an example.

As described above, according to this embodiment, the supply port 41S of the receiving pan 41 is provided on the same side as the doctor knife 42D in plan view, and the liquid introduced through the supply port 41S is made to flow along the spreading roller 42. In the following, the logic (reason) behind this arrangement will be described.

For example, if the supply port 41S of the receiving pan 41 is provided on the opposite side to the doctor knife 42D in plan view (referred to as a "non doctor-knife side"), and the activator K is fed to the receiving pan 41 through the supply port 41S, the liquid surface on the non doctor-knife side is unstable (this has been confirmed by the applicant).

If the introduced activator K does not flow along the spreading roller 42, the introduced liquid flow strongly collides with the spreading roller 42, and the liquid surface is unstable. If a strong flow of the activator K collides with the spreading roller 42, an uncontrollable streak occurs at the site of collision.

In view of these problems, according to this embodiment, the supply port 41S is provided on the same side as the doctor knife 42D in plan view, and the liquid introduced through the supply port 41S is made to flow along the spreading roller 42.

The reason why the introduced liquid is made to flow in one direction from one end to the opposite end of the receiving pan 41 (that is, the reason why the liquid is not introduced at the opposite left and right ends) is as follows: if the liquid is introduced at the opposite ends, the flows of the introduced activator K introduced at the opposite ends strongly collide (merge) with each other somewhere around the center of the spreading roller 42, and thus the liquid surface is unstable.

In summary, according to the present invention, with regard to the flow (fluid motion) of the activator K in the receiving pan 41, the following points are taken into consideration, for example.

Strong collision of the flow of the activator K with the spreading roller 42 should be prevented.

Abrupt change of the flow of the activator K should be prevented as far as possible.

Strong merging of different flows of the activator K should be prevented as far as possible by separating the flows of the activator K.

Figure 9:
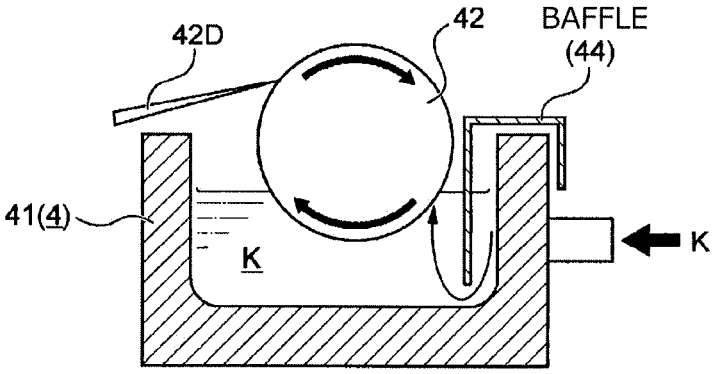
FIG. 9 is a skeletal side view for illustrating that the surface of the activator is unstable when the activator is fed to the receiving pan at a non doctor-knife side.

As shown in FIG. 9, for example, if a baffle (which is equivalent to the adjustment plate 44 described above) is attached to the rear of the spreading roller 42, it can be considered that, even if the activator K is fed to the receiving pan 41 from through the rear vertical wall, which is on the non doctor-knife side, the baffle may prevent the fed activator K from forming a strong flow. However, in that case, the introduced activator K once flows downward and passes by the baffle (passes over the lower edge of the baffle), and thus, the surface of the activator K is unstable (on the non doctor-knife side, in particular).

In the embodiment described above, the clearance between the front edge of the inclined surface part 442 of the adjustment plate 44 and the front vertical wall of the receiving pan 41 is set at 0 mm. However, the clearance may not be 0 mm as far as the inclined surface part 442 can catch a bubble that occurs in the activator K.

Figure 6:
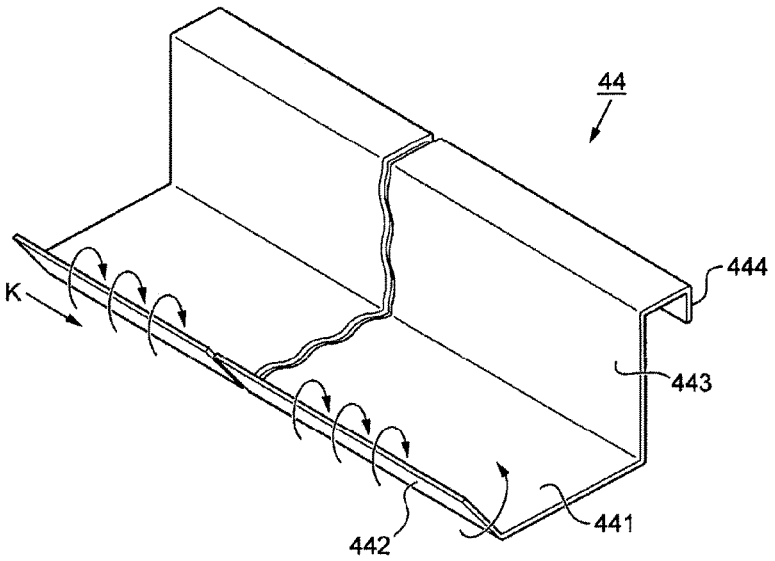
FIG. 6 is a perspective view showing in a skeletal manner how an activator flows when there is a clearance between a front edge of an inclined surface part of the adjustment plate and a front vertical wall of the receiving pan.

In that case, as shown in FIG. 6 as an example, the activator K fed to the receiving pan 41 not only flows along the spreading roller 42 (the rotational axis thereof) but also flows (upward toward the spreading roller 42) over the inclined surface part 442 of the adjustment plate 44 through the clearance. The clearance is set so that the latter flow does not strongly collide with the spreading roller 42.

Next, an advantage of a product manufactured according to the present invention (an article W1 with a hydraulically transferred pattern) will be described.

The article W1 with a hydraulically transferred pattern in which a metallic lustrous pigment (scales of pigment) is applied to the transfer pattern is called metallic tone. With regard to the appearance of the metallic tone, an advantage of the present invention will be described below based on the comparison between the article W1 with a hydraulically transferred pattern according to the present invention and an existing painted article.

<Case of Painting>

Figure 7:
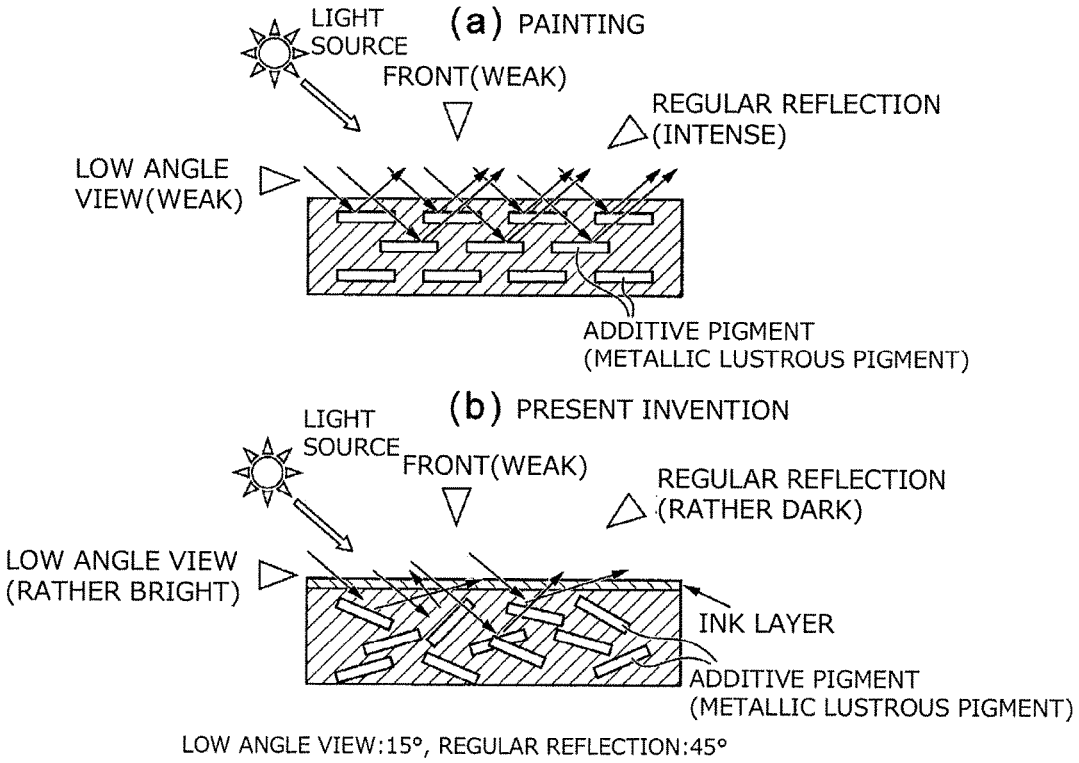
FIG. 7 are diagrams for illustrating an advantage of an article with a hydraulically transferred pattern according to the present invention by comparison with a painted article, FIG. 7(*a*) is a schematic diagram for illustrating how particles of an additive pigment (metallic lustrous pigment) contained in a paint are aligned on the surface of a work piece in the same direction, and FIG. 7(*b*) is a schematic diagram for illustrating how particles of an additive pigment are unevenly disposed (arranged) in the article with a hydraulically transferred pattern according to the present invention.

In the case of painting, thin layers of paint are applied. Thus, as shown in FIG. 7(*a*), for example, aluminum particles (of the metallic lustrous pigment) are aligned in the same direction. Therefore, the regularly reflected light viewed at an angle of 45 degrees with respect to the normal to the surface of the painted product is relatively intense, whereas the reflected light viewed at an angle of approximately 15 degrees with respect to the product surface, that is, the reflected light in so-called "low angle view", is weak. That is, in the case of painting, there is a disadvantage that the brightness significantly varies with the angle at which the product is viewed.

<Case of Article with Hydraulically Transferred Pattern According to Present Invention>

To the contrary, according to the hydraulic transfer method according to the present invention, the activator K is applied one time in the activation step. Therefore, for example, as shown in FIG. 7(*b*), aluminum particles (of the metallic lustrous pigment) in the activator K are less oriented (that is, are not aligned in the same direction), as confirmed by the applicant. Thus, the article W1 with a hydraulically transferred pattern according to the present invention has an advantage that the regularly reflected light and the reflected light in "low angle view" have approximately equal intensities, and the variation in brightness with the angle at which the article is viewed is reduced.

Whether a streak is formed as a design element or not, the metallic tone produced by the metallic lustrous pigment applied to the existing transfer pattern gives a kind of quality or gorgeous appearance to such a metallic-tone article W1 with a hydraulically transferred pattern, even if exactly the same transfer film F as conventional is used. Probably for this reason, the demand for such a metallic-tone article W1 with a hydraulically transferred pattern has been increasingly growing in recent years.

Next, the streak referred to in this specification will be supplementarily described.

Figure 8:
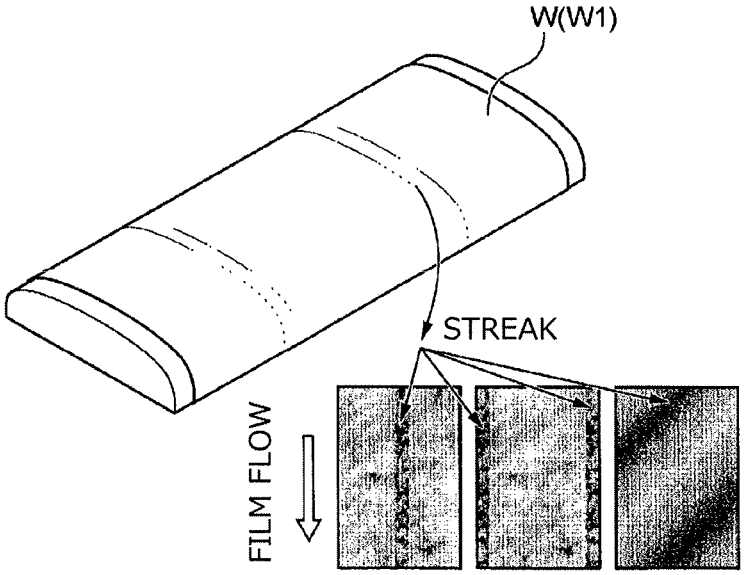
FIG. 8 is a perspective view showing an example of the article with a hydraulically transferred pattern according to the present invention, on which various streaks are formed as design elements.

FIG. 8 shows an example of the article W1 with a hydraulically transferred pattern manufactured by forming streaks on the work piece W as a design element. The streak can be formed not only in the direction of feeding of the transfer film F (the direction of the flow of the transfer film F) but also obliquely as also shown in the drawing. The number of streaks, the position of the streaks, the width (size) of the streaks or the like can be changed as required. An oblique streak can be formed by obliquely disposing the spreading roller 42 with respect to the direction of feeding (the direction of flow) of the transfer film F, for example.

As described above, although occurrence of a streak can be prevented according to the present invention, the present invention is not based on the idea of completely preventing occurrence of any streaks. That is, the present invention is based on the idea of preventing occurrence of any streak caused by an uncontrollable factor (or a factor that is hard to control) (the idea of complete prevention) and is at the same time based on the idea of positively using a streak caused by a controllable factor as a design element.

In other words, there are various kinds of factors that cause a streak such as the property of the additive pigment, the viscosity of the activator K, the rotational speed of the spreading roller 42, the degree of abutment of the doctor knife 42D, the presence of bubbles in the activator K or a change of the flow of the activator K (an abrupt change, a strong merging or the like), and the present invention has been devised based on the concept that occurrence of any streak caused by an uncontrollable factor such as the presence of bubbles is to be completely prevented, and a streak caused by a factor that can be controlled by making the liquid flow more gentle, for example, is to be positively used as a design element or formed outside the effective transfer part.

REFERENCE SIGNS LIST

1 hydraulic transfer apparatus
2 transfer liquid tank
3 transfer film feeding device
4 activator applying device
5 work piece conveying device
2 transfer liquid tank
21 processing tank
22 side wall
3 transfer film feeding device
31 film roll
32 heat roller
33 guide conveyer
34 guide roller

4 activator applying device
41 receiving pan
42 spreading roller
42D doctor knife (doctor blade)
43 additive pigment dispersing mechanism
44 adjustment plate
41 receiving pan
41S supply port
41D discharge port
410 screen wall
43 additive pigment dispersing mechanism
431 overflow tank
432 collection tank
432M impeller
433 supply pump
44 adjustment plate
441 bottom surface part
442 inclined surface part
443 raised surface part
444 engagement part
5 work piece conveying device
51 conveyer
52 link chain
53 link bar
F transfer film
L transfer liquid
K activator
W work piece
W1 article with hydraulically transferred pattern
C1 clearance
C2 clearance
C3 clearance
C4 clearance
C5 clearance
C6 clearance
C7 clearance

The invention claimed is:

1. An activator applying device that applies an activator containing an additive pigment having a different specific gravity to a transfer film, which includes a water-soluble film and a dry transfer pattern formed thereon, during transportation of the transfer film to a transfer liquid tank to activate the transfer pattern on the transfer film when the transfer film with the transfer pattern facing up is fed onto a surface of a liquid in the transfer liquid tank, a work piece is pressed against the transfer film from above, and the transfer pattern is transferred to the work piece by the action of a hydraulic pressure caused by the pressing, wherein the activator applying device comprises:

a receiving pan that stores the activator, and a spreading roller that rotates while being dipped in the activator in the receiving pan and applies the activator that has adhered to a surface of the spreading roller in a dip section of the activator applying device to the transfer pattern in a different section of the activator applying device, the activator is fed to the receiving pan in an amount greater than the amount of the activator applied to the transfer pattern, an excessive activator is discharged through a discharge port of the receiving pan, the discharge port being located on a side where the activator is drawn up from the dip section, opening ends of the discharge port are aligned perpendicular to a direction of movement of the transfer film, and the activator applying device further comprises at least one screen wall that is located only downstream of the spreading roller and that blocks an end part or a part of the discharge port through which the activator is discharged from the receiving pan.

2. The activator applying device according to claim 1, wherein an overflow tank adjacent to the receiving pan is used in discharging the activator from the receiving pan, and the at least one screen wall that blocks the end part or the part of the discharge port through which the activator is discharged from the receiving pan into the overflow tank is provided at a position where a streak is desirably formed.

3. The activator applying device according to claim 2, wherein a doctor knife that makes a thickness of the activator applied to the transfer pattern uniform is provided at a circumferential surface of the spreading roller on the side where the activator is drawn up from the dip section, and the overflow tank is provided adjacent to a vertical wall of the receiving pan on the same side as the doctor knife.

4. The activator applying device according to claim 3, wherein a supply port through which the activator is fed to the receiving pan is provided on the same side as the doctor knife in plan view of the receiving pan.

5. The activator applying device according to claim 4, wherein an adjustment plate is attached to the receiving pan so as to be positioned in the activator stored in the receiving pan, the activator being applied to the transfer pattern when the adjustment plate is attached to the receiving pan, and the adjustment plate is attached to the receiving pan so as to be positioned between the supply port of the receiving pan and the spreading roller in side view.

6. The activator applying device according to claim 5, wherein the adjustment plate has a rectifying function of isolating or separating a flow of the activator above the adjustment plate that is drawn up mainly along the circumferential surface of the spreading roller and a flow of the activator below the adjustment plate that is fed to the receiving pan.

7. The activator applying device according to claim 1, wherein the discharge port through which the activator is discharged from the receiving pan has an opening dimension equal to or greater than a width of the transfer film.

8. The activator applying device according to claim 1, wherein a width and a position of the opening ends of the discharge port through which the activator is discharged from the receiving pan are configured to be adjustable.

9. The activator applying device according to claim 8, wherein the width and the position of the opening ends of the discharge port are adjustable with the at least one screen wall the at least one screen wall is aligned perpendicular to a direction of movement of the transfer film, and the at least one screen wall is removably attachable.

* * * * *